US009499331B2

(12) United States Patent
Seyfferth De Oliveira

(10) Patent No.: US 9,499,331 B2
(45) Date of Patent: Nov. 22, 2016

(54) REINFORCED RESEALABLE INNER PACKAGE FOR CONTAINER

(71) Applicant: PHILIP MORRIS PRODUCTS S.A., Neuchatel (CH)

(72) Inventor: Daniel Seyfferth De Oliveira, Curitiba (BR)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/377,949

(22) PCT Filed: Feb. 13, 2013

(86) PCT No.: PCT/EP2013/052905

§ 371 (c)(1),
(2) Date: Aug. 11, 2014

(87) PCT Pub. No.: WO2013/120913

PCT Pub. Date: Aug. 22, 2013

(65) Prior Publication Data

US 2015/0021219 A1 Jan. 22, 2015

(30) Foreign Application Priority Data

Feb. 15, 2012 (EP) ..... 12155617

(51) Int. Cl.
*B65D 85/10* (2006.01)

(52) U.S. Cl.
CPC ..... *B65D 85/1045* (2013.01)

(58) Field of Classification Search
CPC ..... B65D 85/1045; B65D 85/10; B65D 85/1036; B65D 85/1054; A24F 23/00; A24F 15/00; A24F 15/12
USPC ..... 206/268, 273, 264, 271, 242, 250; 220/259.2
See application file for complete search history.

(56) References Cited

U.S. PATENT DOCUMENTS 4,300,676 A * 11/1981 Focke et al. ..... 206/264
5,307,925 A 5/1994 Focke (Continued)

FOREIGN PATENT DOCUMENTS

CN 1237940 12/1999
CN 1635973 7/2005

(Continued)

OTHER PUBLICATIONS

European Extended Search Report for Application No. 12155617.9-2308 dated Oct. 26, 2012 (9 pages).

(Continued)

*Primary Examiner* — Steven A. Reynolds
(74) *Attorney, Agent, or Firm* — Mueting, Raasch & Gebhardt, P.A.

(57) ABSTRACT

The present invention relates to a container (100) for consumer goods. The container (100) comprises an outer housing, including a box (102) and a lid (104). The container also comprises an inner package (106) of consumer goods within the outer housing having an access opening through which consumer goods can be removed, an inner frame (112) within the inner package, and an adhesive label (108) covering the access opening of the inner package and extending beyond the periphery of the access opening of the inner package, the adhesive label (108) being at least partially releasably affixed to the outer surface of the inner package (106) by a releasable adhesive. At least one portion of the inner surface of the inner package (106) is permanently affixed, using affixing means, to a corresponding portion of the outer surface of the inner frame (112).

29 Claims, 2 Drawing Sheets

(56) References Cited

U.S. PATENT DOCUMENTS

| | | | | |
|---|---|---|---|---|
| 5,682,986 | A * | 11/1997 | Cobler | A24F 15/18 206/246 |
| 6,164,444 | A * | 12/2000 | Bray | B65D 75/5838 206/264 |
| 6,478,149 | B1 * | 11/2002 | Parker | 206/273 |
| 6,505,735 | B1 * | 1/2003 | Parker | 206/268 |
| 7,290,652 | B2 | 11/2007 | Rath | |
| 7,353,940 | B2 * | 4/2008 | Sendo | B65D 85/1036 206/268 |
| 7,395,924 | B2 * | 7/2008 | Tambo | B65D 85/1045 206/268 |
| 7,537,113 | B2 * | 5/2009 | Tambo | 206/264 |
| 7,600,668 | B2 | 10/2009 | Pham | |
| 7,827,769 | B2 * | 11/2010 | Bertuzzi et al. | 53/466 |
| 8,091,703 | B2 * | 1/2012 | Marchetti et al. | 206/268 |
| 8,123,030 | B2 | 2/2012 | Hein | |
| 8,365,978 | B2 * | 2/2013 | Yoshimura et al. | 229/87.05 |
| 8,579,108 | B2 * | 11/2013 | Tanbo | B65D 77/02 206/242 |
| 2005/0130822 | A1 * | 6/2005 | Rath | 493/309 |
| 2005/0252796 | A1 * | 11/2005 | Sendo | 206/261 |
| 2008/0093234 | A1 * | 4/2008 | Jones | B65D 85/1072 206/271 |
| 2009/0255835 | A1 * | 10/2009 | Pipes et al. | 206/273 |
| 2010/0230303 | A1 * | 9/2010 | Buse et al. | 206/268 |
| 2010/0252462 | A1 * | 10/2010 | Marchetti | B65D 5/606 206/268 |
| 2011/0114518 | A1 * | 5/2011 | Hein | 206/268 |
| 2011/0147443 | A1 * | 6/2011 | Igo | 229/117.31 |
| 2011/0303567 | A1 | 12/2011 | Bray | |
| 2012/0006823 | A1 * | 1/2012 | Bertuzzi et al. | 220/270 |

FOREIGN PATENT DOCUMENTS

| | | |
|---|---|---|
| CN | 101228078 | 6/2011 |
| CN | 102112378 | 6/2011 |
| CN | 102245481 | 11/2011 |
| EP | 0 650 907 | 5/1995 |
| EP | 0942880 | 1/2001 |
| EP | 1289859 | 11/2004 |
| EP | 2 366 637 | 9/2011 |
| GB | 2451180 A | 1/2009 |
| WO | WO 98/22367 | 5/1998 |
| WO | WO 03/042044 | 5/2003 |
| WO | WO 2008/142540 | 11/2008 |
| WO | WO 2009/098297 | 8/2009 |
| WO | WO 2011/009520 | 1/2011 |
| WO | WO 2011/076405 | 6/2011 |

OTHER PUBLICATIONS

PCT International Search Report and Written Opinion for International Application No. PCT/EP2013/052905 dated Jul. 24, 2013 (14 pages).

Communication Pursuant to Rule 114(2) EPC for Application No. 13709154.2 (2 pages).

Chinese Office Action for Application No. 201380009554.1 dated Jul. 23, 2015 (17 pages). English translation included.

Third party observations issued in European Patent Application No. 13709154.2 dated Apr. 20, 2016 (7 pages).

Office Action issued in Taiwan for Application No. 102105234 dated Jul. 7, 2016 (6 pages). English translation included.

* cited by examiner

REINFORCED RESEALABLE INNER PACKAGE FOR CONTAINER

This application is a U.S. National Stage Application of International Application No. PCT/EP2013/052905, filed Feb. 13, 2013, which was published in English on Aug. 22, 2013 as International Patent Publication WO 2013/120913 A1. International Application No. PCT/EP2013/052905 claims priority to European Application No. 12155617.9 filed Feb. 15, 2012.

The present invention relates to a container for consumer goods with a resealable inner package, the inner package having reinforcing elements. The container finds particular application as a container for elongate smoking articles, such as cigarettes.

Smoking articles such as cigarettes and cigars are commonly packaged in rigid hinge-lid containers having a box and a lid connected to the box about a hinge line extending across the rear wall of the container. Such hinge-lid containers are typically constructed from one-piece laminar cardboard blanks. In use, the lid is pivoted about the hinge line to open the container and so gain access to a bundle of smoking articles housed in the box.

The bundle of smoking articles housed in the box is typically wrapped in an inner liner of metalized paper, metal foil or other flexible sheet material. To access the bundle of smoking articles within the inner liner, a consumer typically removes and discards a pre-perforated upper portion of the inner liner upon first opening the hinge-lid container.

However, to provide improved protection against the ingress and egress of, for example, air, moisture, flavours and odours, it is also known to enclose the bundle of smoking articles in a resealable substantially airtight wrapper.

For example, EP-A-0 944 539 discloses a hinge-lid pack of smoking articles in which the smoking articles are enclosed in a sealed enclosure of a layer of barrier material having an access aperture defined therein. The access aperture is covered by a cover layer with a permanently tacky surface, which can be engaged with the layer of barrier material to reseal the enclosure after first opening the aperture. A frame against which the cover layer may be pressed to ensure good resealing is provided in the sealed enclosure between the smoking articles and the layer of barrier material. To aid opening and reopening of the sealed enclosure, a non-adhesive tab is provided at the bottom edge of the cover layer.

WO-A-2008/142540 also discloses a hinge-lid pack of smoking articles in which the smoking articles are enclosed in an inner package with an extraction opening closed by a cover flap that is fixed to the inner package using non-dry re-stick adhesive applied to the underside of the cover flap. The inner or outer surface of a bottom tab of the cover layer is glued permanently and non-removably to an inner surface of the lid of the hinge-lid pack so that opening and closing the lid simultaneously also opens and closes the cover flap.

When the cover layer or flap of known smoking article containers is closed, the pressure required to re-stick the cover may cause the inner package to deform and provide a less efficient seal between the cover and the inner package.

EP 2 366 637 discloses a hinge-lid packet comprising a cup-shaped outer container and a sealed inner package. The sealed inner package houses a group of cigarettes and has at its top and front a central cigarette extraction opening that is closed by a reclosable sealing panel. The packet comprises a rigid collar glued to the inner package and folded about the inner package to at least partly cover a top portion of the inner package. The reclosable sealing panel for closing the extraction opening is located over the collar and its inner surface is gummed with re-stick adhesive. The sealing panel adheres to the collar when the extraction opening is closed.

When the sealing panel is closed the inner package is sealed in a less efficient way, because the inner package itself is not sealed but rather the sealing panel is releasably affixed to the collar.

WO 2001/009520 discloses a further cigarette pack comprising a hinge-lid box and a sealed block-shaped inner package inside the hinge-lid box. The inner package comprises an inner sheet surrounding a C-shaped inner frame, which in turn surrounds a bundle of cigarettes. The inner sheet comprises an inner layer and an outer layer. The inner package has an access opening at its upper end and an opening tab, formed from the inner layer of the inner sheet, that closes the access opening. An operating tab formed from the outer layer of the inner sheet overlies and is affixed to the opening tab. The operating tab is larger than the opening tab and extends beyond the opening tab and access opening on three sides, forming a U-shaped sealing strip. The access opening is sealed at manufacture by a permanent adhesive along the U-shaped sealing strip. To break the seal, the user pulls an unglued portion of the operating tab.

The opening tab of WO 2001/009520 is reclosable, but not resealable which reduces the efficiency of the inner package at protecting the cigarettes.

EP 0 650 907 discloses a hinge-lid pack with rounded longitudinal edges comprising a collar. The collar is adhesively connected to the inner side of the pack front panel. A portion of the collar projects upwardly from the pack and has an outwardly directed deformation so that it projects laterally slightly beyond the contours of the pack part. When the lid is closed the inner faces of the lid side panels contact the collar with increased pressure, which leads to increased friction.

The pack of EP 0 650 907 does not disclose an inner package for sealing and protecting the contents of the pack which reduces the efficiency of the pack at protecting the contents.

According to a first aspect of the present invention, there is provided a container for consumer goods comprising an outer housing. The outer housing comprises a box, and a lid. The container further comprises an inner package of consumer goods within the outer housing having an access opening through which consumer goods can be removed. The container further comprises an inner frame within the inner package and an adhesive label, wherein the adhesive label is covering the access opening of the inner package and is extending beyond the periphery of the access opening of the inner package. The adhesive label is at least partially releasably affixed to an outer surface of the inner package by a releasable adhesive. The at least one portion of the inner surface of the inner package is permanently affixed, using affixing means, to a corresponding portion of the outer surface of the inner frame.

The term "inner surface" is used throughout the specification to refer to the surface of a component of the assembled container that is facing towards the interior of the container, for example towards the consumer goods, when the container is in the closed position. Likewise, the term "outer surface" is used throughout the specification to refer to the surface of a component of the container that is facing towards the exterior of the container. For example, the inner frame comprises an outer surface that is facing the outer housing of the container and an inner surface that is facing the inner package of the container. It should be noted, that the inside or outside surface is not necessarily equivalent to a certain side of a blank used in assembly of the container. Depending on how the blank is folded around the consumer goods, areas that are on the same side of the container can either face towards the inside or the towards the outside of the container.

By providing affixing means to permanently affix a portion of the outer surface of the inner package to a corresponding portion of the inner surface of the inner frame, a container may be provided that provides a more securely sealed inner package since the combination of the inner frame and the affixing means provides a more structurally resilient inner package more able to resist the force required to form a seal between the adhesive label and the inner package. Therefore, advantageously, the partially releasably affixed adhesive label cooperates with the more structurally resilient inner package to form the improved seal between the adhesive label and the outer surface of the inner package. Thus, a container is provided with an improved quality of closing.

In a first preferred embodiment, the outer housing of the container comprises a box, and a lid hinged to the box along a hinge line extending across a rear wall of the container.

In this preferred embodiment, the adhesive label may be permanently affixed to the inner surface of the front wall of the lid such that upon opening the lid the adhesive label is peeled away to reveal the access opening. As such, when a user opens the lid of the container, the adhesive label is automatically opened to reveal the access opening, and when the user closes the lid, the adhesive label is automatically closed to reseal the access opening. By providing affixing means to improve the structural resilience of the inner package, an automatically opening container is provided with improved sealing.

Preferably, the at least one portion of the inner surface of the inner package is provided at a distance from the access opening of less than about 30 percent of the distance from the opening to the bottom of the inner package. More preferably, the at least one portion of the inner surface of the inner package is provided at a distance from the access opening of less than 20 percent of the distance from the opening to the bottom of the inner package. Yet more preferably, the at least one portion of the inner surface of the inner package is provided at a distance from the access opening of less than 10 percent of the distance from the opening to the bottom of the inner package.

The closer the at least one portion of the inner surface of the inner package is to the opening of the inner package, the better is the rigidity of the inner package in the area of the adhesive label. This improves significantly the subsequent reclosability of the inner package by the adhesive label. This is particularly important when the inner package is no longer completely filled. While the inner package is completely filled or at least substantially filled, the consumer goods provide some backing for the inner package for reclosing the adhesive label. Once the inner package becomes emptier, this backing is missing and, depending on the rigidity of the inner package material, the adhesive label or the inner package may deform and provide a less efficient seal between the label and the inner package. In containers according to the invention, this disadvantage is prevented due to the position of the at least one portion of the inner surface of the inner package that is attached to the outer surface of the inner frame close to the opening of the inner package.

Preferably, the affixing means is elongate, and is oriented such that the major axis of the affixing means is in the transverse direction. The affixing means may extend across substantially the entire width of the inner frame, or alternatively across about 90 percent of the width of the inner frame, or across about 80 percent of the width of the inner frame.

In an alternative embodiment, the affixing means is elongate, and is oriented such that the major axis of the affixing means is in the longitudinal direction. In this alternative embodiment, the affixing means may extend along substantially the entire height of the inner frame, or alternatively along about 90 percent of the height of the inner frame, or along about 80 percent of the height of the inner frame.

The container may comprise a plurality of spaced apart affixing means. Preferably, the container comprises at least three spaced apart fixing means. The plurality of affixing means are preferably spaced apart in the longitudinal direction. The plurality of affixing means may be spaced apart by a distance of less than about 20 percent of the height of the inner frame, or alternatively by a distance of less than about 15 percent of the height of the inner frame, or alternatively by a distance of less than about 10 percent of the height of the inner frame.

In the alternative embodiment where the affixing means is oriented such that the major axis of the affixing means is in the longitudinal direction, the plurality of affixing means are spaced apart in the transverse direction. Where the container comprises at least three spaced apart affixing means, the affixing means are preferably arranged such that a first and third affixing means are evenly positioned on either side of a second affixing means, the second affixing means being positioned centrally on the inner frame.

At least a portion of the outer surface of the rear wall of the inner package may be permanently affixed to a corresponding portion of the inner surface of the rear wall of the box.

The affixing means may be provided on the inner frame. Alternatively, or in addition, the affixing means may be provided on the inner package. Where the affixing means is provided on the inner frame, it is preferably provided on the outer surface of the front wall of the inner frame. Where the affixing means is provided on the inner package, it is preferably provided on the inner surface of the front wall of the inner package.

At least a portion of the outer surface of the front wall of the inner package may be permanently affixed to a corresponding portion of the inner surface of the front wall of the box. By permanently affixing at least a portion of the inner package to the front wall of the box, the structural resilience of the inner package may be further improved.

The inner package may be permanently affixed using at least one of the following affixing means: hot melt adhesive; solvent based adhesive; water based adhesive; solvent-free adhesive; pressure-sensitive adhesive; conductive type sealing; and inductive type sealing. In a preferred embodiment, the affixing means is a hot melt adhesive.

Preferably, the inner frame is a U-shaped inner frame having a front wall and a pair of opposed side walls. The term "U-shaped" is used herein to refer to a shape that comprises three parts, wherein the first part and the third part are parallel to each other and extend in the same direction perpendicular to the second part.

Preferably, the front wall of the inner frame is provided adjacent the front wall of the inner package. Advantageously, an inner frame with a large surface area provided adjacent the front wall of the inner package increases the structural strength of the container. The increased structural strength provided by the inner frame allows the more secure closing of the adhesive label. This is particularly advantageous for subsequent closing operations when the container is no longer full.

Preferably, the inner frame comprises a cut-out at the top of the front wall. The cut-out preferably substantially corresponds to the access opening, and is provided such that the consumer goods within the inner package may be more easily accessed. Where the inner frame comprises a cut-out, the height of the inner frame is defined as the distance from the bottom of the inner frame to the cut-out.

The inner frame may comprise reinforcing means. Preferably, the reinforcing means comprises the affixing means, such that the affixing means reinforces the inner frame and inner package. Alternatively, the reinforcing means may comprise at least one layer of material, such as a similar cardboard to that utilized for manufacturing the inner frame, affixed to the inner frame. In this alternative, the at least one further layer of material is permanently affixed to the inner frame. Preferably, the at least one further layer is elongate. Where the inner frame is U-shaped, the at least one layer of material is preferably affixed to the outer surface of the front wall of the inner frame. Preferably, the at least one layer is affixed adjacent the top of the inner frame.

The adhesive label provided for covering the access opening comprises a resealable adhesive, such that the label can be removed from a surface of the inner package and reattached a number of times. This allows for repeated opening and closing of the inner package in order to access the consumer goods individually. The resealable adhesive on the adhesive label will preferably provide sufficient adhesion for the label to be reattached at least as many times as there are consumer goods within the inner package. This enables a consumer to open and reseal the inner package until the package is empty.

Suitable resealable adhesives would be known to the skilled person and a wide variety of adhesives are commercially available from a number of suppliers. The selection of a suitable adhesive may depend upon the material forming the inner package to which the adhesive label is sealed or resealed during use.

The adhesive label preferably comprises an adhesive free surface area, wherein this adhesive free surface area substantially corresponds in size to the access opening in the inner package. When the lid is in the closed position with the adhesive label sealed to the inner package, this adhesive free surface area covers the access opening in the inner package. This will prevent dust or small particles, for example tobacco shorts or other residue from the consumer goods within the package, from adhering to the adhesive label. This can happen if the adhesive label comes into contact with the consumer goods within the inner package.

The access opening of the inner package may be defined by one or more lines of weakness in the inner package. In this embodiment, the one or more lines of weakness define an access portion of the inner package. By providing the inner package with a defined access portion the inner package may be more securely sealed before the first opening of the container. This may increase the storage life of the consumer goods contained within the container. In this embodiment, the adhesive label preferably comprises a further area of the inner surface of the adhesive label permanently affixed to the access portion of the inner package bounded by the one or more lines of weakness. The access portion of the inner package is preferably partially separated from the remainder of the inner package along the one or more lines of weakness on first opening of the lid of the outer housing such that the access portion of the inner package remains attached to the remainder of the inner package during subsequent opening and closing of the lid of the outer housing. The resealable adhesive provided on the first area of the inner surface of the adhesive label may extend about substantially the entire periphery of the access portion of the inner package.

Preferably, the adhesive label is permanently affixed to the inner package, at least in one area. More preferably, the adhesive label is permanently affixed to the inner package by a connection portion extending about substantially the entire periphery of the adhesive label. The connection portion is connected to the adhesive label along an edge of the adhesive label adjacent an edge of the access portion. Preferably, the connection edge is located towards the rear of the top side of the inner package.

As used herein, the terms 'front', 'back, 'upper', 'lower', 'top', 'bottom' and 'side', refer to the relative positions of portions of containers according to the invention and components thereof when the container is in an upright position with the lid of the outer housing in the closed position and the hinge line at the rear of the container. When describing containers according to the present invention, these terms are used irrespective of the orientation of the container being described. The back wall of the container is the wall comprising the hinge line.

The term "longitudinal" refers to a direction from bottom to top or vice versa. The term "transverse" refers to a direction perpendicular to the longitudinal direction.

As used herein, the term "height" refers to the dimension of the respective portion of the adhesive label measured in the longitudinal direction when the adhesive label is affixed to the inner package. The term "width" refers to the dimension of the respective portion of the adhesive label measured in the transverse direction when the adhesive label is affixed to the inner package.

The container is preferably a rectangular parallelepiped comprising two wider walls spaced apart by two narrower walls.

Preferably, the lid and the box are connected along a hinge line.

The term "hinge line" refers to a line about which the lid may be pivoted in order to open the container. A hinge line may be, for example, a fold line or a score line in the panel forming the back wall of the container.

The container may be formed from any suitable materials including, but not limited to, cardboard, paperboard, plastic, metal, or combinations thereof. Preferably, the outer housing are each formed from one or more folded laminar cardboard blanks and preferably, the cardboard has a weight of between about 100 grams per square metre and about 350 grams per square metre.

Preferably, the inner package is formed of metal foil or metalized paper. The inner package material may be formed as a laminate of a metalized polyethylene film, and a liner material. The liner material may be a supercalendered glassine paper. In addition, the inner package material may be provided with a print-receptive top coating.

As described above, containers according to the invention may be in the shape of a rectangular parallelepiped, with right-angled longitudinal and right-angled transverse edges. Alternatively, the container may comprise one or more rounded longitudinal edges, rounded transverse edges, beveled longitudinal edges or beveled transverse edges, or combinations thereof. For example, the container according to the invention may comprise, without limitation:

One or two longitudinal rounded or beveled edges on the front wall, and/or one or two longitudinal rounded or beveled edges on the back wall.

One or two transverse rounded or beveled edges on the front wall, and/or one or two transverse rounded or beveled edges on the back wall.

One longitudinal rounded edge and one longitudinal beveled edge on the front wall, and/or one transverse rounded edge and one transverse beveled edge on the back wall.

One or two transverse rounded or beveled edges on the front wall and one or two longitudinal rounded or beveled edges on the front wall.

Two longitudinal rounded or beveled edges on a first side wall or two transverse rounded or beveled edges on the second side wall.

Where the container comprises one or more beveled edge, preferably the beveled edge has a width of between about 1 mm and about 10 mm, preferably between about 2 and about 6 mm. Alternatively, the container may comprise a double bevel formed by three parallel creasing or scoring lines that are spaced such that two distinct bevels are formed on the edge of the container.

Alternatively, the container may have a non-rectangular transversal cross section, for example polygonal such as triangular or hexagonal, semi-oval or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 mm and about 180 mm), diameter (for example, between about 4 mm and about 9 mm). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that, in the closed lid position, the resultant overall dimensions of the container are similar to the dimensions of a typical disposable hinge-lid pack of twenty cigarettes.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container (comprising the hinge between box and lid).

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

Where the container comprises smoking articles, the container may further comprise waste-compartments (for example for ash or butts) or other consumer goods, for example matches, lighters, extinguishing means, breath-fresheners or electronics. The other consumer goods may be attached to the outside of the container, contained within the container along with the smoking articles, in a separate compartment of the container or combinations thereof.

The exterior surfaces of containers according to the invention may be printed, embossed, debossed or otherwise embellished with manufacturer or brand logos, trade marks, slogans and other consumer information and indicia.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more a tear tapes. In addition, the over wrapper may be printed with images, consumer information or other data.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 3A:
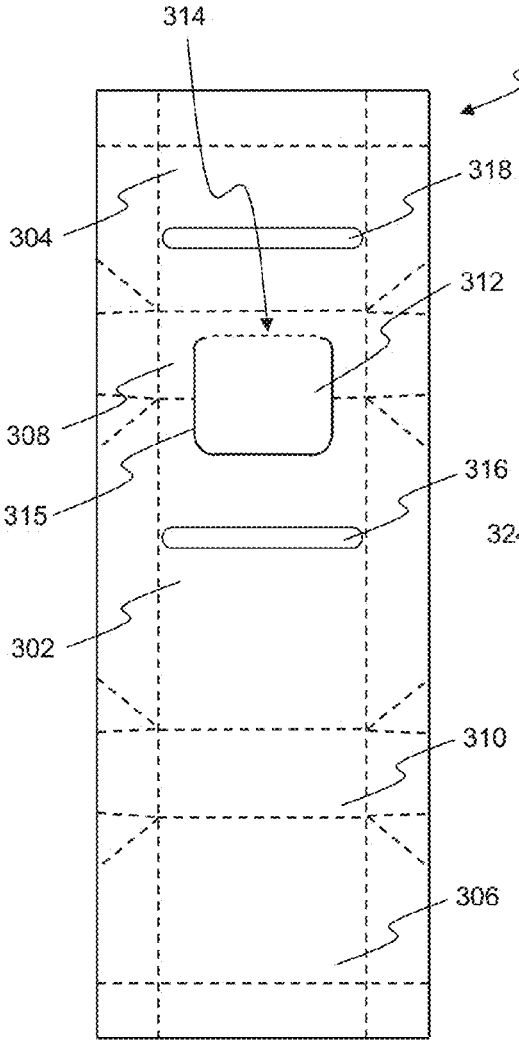
Figure 3B:
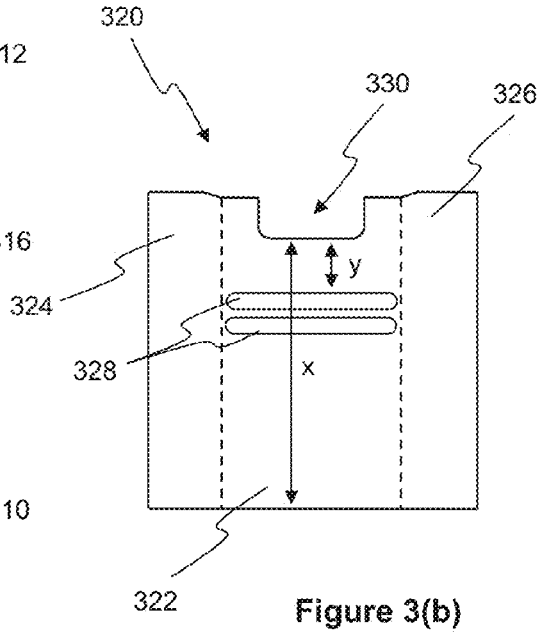

FIGS. 3(*a*) and (*b*) show examples of blanks used for the inner package and the inner frame respectively.

Figure 1:
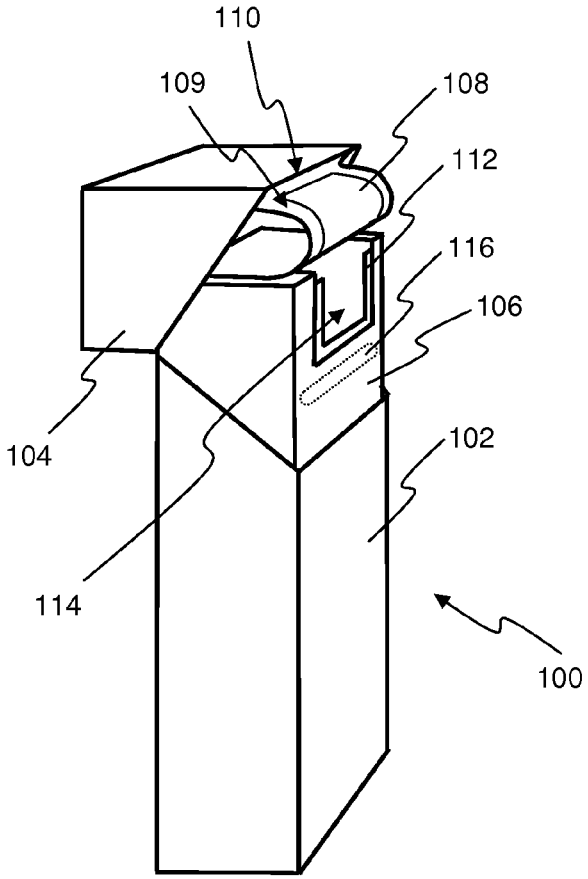
FIG. 1 shows a perspective view of one embodiment of a container with the lid in an open position.

FIG. 1 shows a container 100 for consumer goods. The container comprises a box 102, and a lid 104 coupled to the box via a hinge line (not shown). The hinge line extends across the back of the container 100, and acts to allow the lid 104 to be moved from a closed position to the open position shown in FIG. 1. An inner package 106 is housed within the box 102, and comprises an access opening. The inner package 102 is made from a barrier material in order to hermetically seal the consumer goods before the container is opened for the first time. The barrier material may be a metal foil or a metalized paper.

The access opening of the inner package is formed by lines of weakness in the inner package material, and thus until the container is opened for the first time the inner package forms a sealed enclosure for the consumer goods. To enable the inner package to be resealed after the first opening, an adhesive cover label 108 is provided to enable the access opening to be covered. The adhesive cover label is permanently affixed to the outer surface of the inner package adjacent the top rear corner. In addition, the adhesive label is permanently affixed to the access portion of the outer surface of the inner package defined by the lines of weakness surrounding the access opening, and thus when the adhesive label is moved from the closed position to the open position the access opening of the inner package is revealed. The adhesive label is also provided with resealable adhesive in the area 109 adjacent the periphery of the access opening to enable the adhesive label to be resealed to the outer surface of the inner package a number of times.

Consumer goods are provided within the inner package 106. As can be seen, the adhesive label 108 is connected to the lower edge 110 of the front wall of the lid 104. By connecting the adhesive label to the lid, the adhesive label is automatically peeled from the inner package when the lid is moved from the closed position to the open position, allowing access to the consumer goods. Likewise, when the lid is moved from the open position to the closed position, the adhesive label is automatically resealed to the inner package.

To increase the resilience of the inner package 106 to the forces associated with the adhesive label 108 being peeled from, and especially resealed to, the inner package an inner frame 112 is provided within the inner package 106. The inner frame 112 is a U-shaped element with a front wall and two opposed side walls. The front wall is provided adjacent the front wall of the inner package. As can be seen, the inner frame comprises a cut-out 114 that corresponds to the shape of the access opening within the inner package 106. The cut-out within the inner frame allows the consumer goods to be accessed more easily.

To further increase the resilience of the inner package, a reinforcing element 116 is provided between the inner package and the inner frame. The reinforcing element 116 acts to increase the stiffness of the inner package, and thus it is better able to resist the forces associated with closing the lid of the container. The reinforcing element is described in further detail below.

Figure 2:
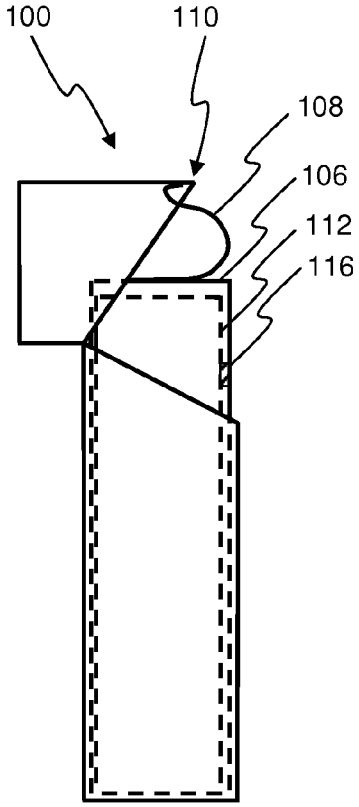
FIG. 2 shows side view of the container shown in FIG. 1.

FIG. 2 shows a side view of the container 100, again with the lid in the open position. The inner package 106 is shown within the outer housing box 102, and the inner frame 112 is within the inner package. The adhesive cover label is shown attached to the lid 104. In the open position, the adhesive cover label forms an S-shape. The geometry of the container is such that the adhesive label is automatically resealed to the inner package when the lid is moved from this open position to the closed position. As can be seen, the reinforcing element 116 is positioned between the inner frame and the inner package.

The reinforcing element 116 is elongate and is arranged such that the main axis of the element is in the transverse direction of the container. The element is positioned substantially adjacent the top of the inner frame, at a distance from the top of about 10 percent of the overall height of the inner frame from the bottom to the cut-out. The reinforcing element is an adhesive, such as a hot melt adhesive, that joins the inner frame to the inner package. Joining the inner frame to the inner package increases the stiffness of the combination of the inner frame and inner package as compared to the combination of the inner frame and inner package without being joined together. The stiffness, and hence resistance to being inwardly deformed during the closing process, is increased since the inner frame and inner package form a composite material. In addition, the added material of the adhesive increases the stiffness of the inner package.

FIGS. 3(*a*) and 3(*b*) show the pre-assembled inner package and inner frame respectively. The pre-assembled inner package 300 shown in FIG. 3(*a*) comprises a front wall panel 302, two wall panels 304 and 306 that form the back wall panel of the inner package when assembled, a top wall panel 308 and a bottom wall panel 310. The pre-assembled inner package 300 also comprises a plurality of side wall panels. As can be seen, an access portion 312 is provided across a portion of the top wall panel 308 and the front wall panel 302. As described above, the access portion is permanently attached to the inner package along a rear folding line 314, and detachably connected to the inner package around the remaining periphery of the access portion by lines of weakness 315. The reinforcing means 316, in the form of an elongate line of adhesive, is provided on the inner surface of the front wall panel of the pre-assembled inner package. The adhesive 316 is adapted to permanently adhere to the inner frame. A further elongate line of adhesive 318 may be provided on outer surface of the rear wall panel of the inner package to enable the inner package to be permanently affixed to the box of the container.

FIG. 3(*b*) shows the pre-assembled inner frame 320. As described above, the inner frame comprises a front wall panel 322, and two opposed side wall panels 324 and 326. The outer surface of the front wall panel 322 is provided with a reinforcing element 328. In the embodiment shown in FIG. 3(*b*), the reinforcing element 328 is two elongate lines of adhesive that are adapted to permanently affix the outer surface of the front wall of the inner frame to the inner surface of the front wall panel of the inner package when the container is assembled. In addition, and as described above, a cut-out 330 is provided at the top of the front wall panel of the inner frame. The cut-out is provided to allow the consumer goods housed within the container to be access more easily. The cut-out is provided such that, when the inner frame is within the inner package, it aligns with the access opening provided in the inner package. As can be seen, the reinforcing element 328 is provided at a distance y from the cut-out. In a preferred embodiment, the distance y is approximately 10 percent of the overall height of the inner frame x.

The dashed lines in the above described figures indicate fold lines.

The invention claimed is:

1. A container for consumer goods, comprising:

an outer housing, comprising:

a box; and a lid;

an inner package of consumer goods within the outer housing having an access opening through which consumer goods can be removed;

an inner frame within the inner package; and an adhesive label covering the access opening of the inner package and extending beyond the periphery of the access opening of the inner package, the adhesive label being at least partially releasably affixed to an outer surface of the inner package by a releasable adhesive, wherein the adhesive label is permanently affixed to an outer surface of the inner package and the inner surface of the front wall of the lid such that upon opening the lid, the adhesive label is peeled away to reveal the access opening and forms an S-shape, wherein at least one portion of an inner surface of the inner package is permanently affixed, using affixing means, to a corresponding portion of an outer surface of the inner frame.

2. A container according to claim 1, wherein the at least one portion of the inner surface of the inner package is provided at a distance from the access opening of less than 30 percent of the distance from the opening to the bottom of the inner package.

3. A container according to claim 1, wherein the affixing means for affixing the at least one portion of an inner surface of the inner package to a corresponding portion of an outer surface of the inner frame is elongate, and is oriented such that the major axis of the affixing means is in the transverse direction.

4. A container according to claim 1, comprising a plurality of spaced apart affixing means for affixing the at least one portion of an inner surface of the inner package to a corresponding portion of an outer surface of the inner frame.

5. A container according to claim 1, wherein the inner frame is U-shaped and has a front wall and a pair of opposed side walls.

6. A container according to claim 5, wherein the front wall of the inner frame is provided adjacent the front wall of the inner package.

7. A container according to claim 1, wherein at least a portion of the outer surface of the rear wall of the inner package is permanently affixed to a corresponding portion of the inner surface of the rear wall of the box.

8. A container according to claim 1, wherein at least one portion of the inner surface of the inner package is permanently affixed using at least one of the following affixing means: hot melt adhesive; solvent based adhesive; water based adhesive; solvent-free adhesive; pressure-sensitive adhesive; conductive type sealing; and inductive type sealing.

9. A container according to claim 1, wherein the affixing means affixing the said at least one portion of the inner package to a corresponding portion of an outer surface of the inner frame is provided on an outer surface of a front wall of the inner frame.

10. A container according to claim 1, wherein the affixing means affixing the said at least one portion of the inner package to a corresponding portion of an outer surface of the inner frame is provided on an inner surface of a front wall of the inner package.

11. A container according to claim 1, wherein at least a portion of the outer surface of the front wall of the inner package is permanently affixed to a corresponding portion of the inner surface of the front wall of the box.

12. A container according to claim 1, wherein the access opening of the inner package is defined by one or more lines of weakness in the inner package.

13. A container according to claim 12, wherein the adhesive label is permanently affixed to the portion of an outer surface of the inner package bounded by the one or more lines of weakness.

14. A container according to claim 1, wherein the adhesive label is permanently affixed to an outer surface of the inner package and the inner surface of the front wall of the lid such that upon opening the lid the adhesive label is peeled away to reveal the access opening.

15. A container according to claim 1, wherein the consumer goods are smoking articles.

16. A container according to claim 1, wherein the adhesive label is permanently affixed to the inner surface of the lid only at the front wall of the lid.

17. A container according to claim 1 wherein the adhesive label is permanently affixed to the inner surface of the lid at a lower edge of the front wall.

18. A container according to claim 17 wherein the at least one portion of the inner surface of the inner package is provided at a distance from the access opening of less than 30 percent of the distance from the opening to the bottom of the inner package.

19. A container according to claim 17 wherein the affixing means affixing the said at least one portion of the inner package to a corresponding portion of an outer surface of the inner frame is elongate, and is oriented such that the major axis of the affixing means is in the transverse direction.

20. A container according to claim 17 comprising a plurality of spaced apart affixing means for affixing the at least one portion of an inner surface of the inner package to a corresponding portion of an outer surface of the inner frame.

21. A container according to claim 17 wherein the inner frame is U-shaped and has a front wall and a pair of opposed side walls.

22. A container according to claim 21 wherein the front wall of the inner frame is provided adjacent the front wall of the inner package.

23. A container according to claim 17 wherein at least a portion of the outer surface of the rear wall of the inner package is permanently affixed to a corresponding portion of the inner surface of the rear wall of the box.

24. A container according to claim 17 wherein at least one portion of the inner surface of the inner package is permanently affixed to a corresponding portion of an outer surface of the inner frame using at least one of the following affixing means: hot melt adhesive; solvent based adhesive; water based adhesive; solvent-free adhesive; pressure-sensitive adhesive; conductive type sealing; and inductive type sealing.

25. A container according to claim 17 wherein the affixing means affixing the said at least one portion of the inner package to a corresponding portion of an outer surface of the inner frame is provided on an outer surface of a front wall of the inner frame.

26. A container according to claim 17 wherein the affixing means affixing the said at least one portion of the inner package to a corresponding portion of an outer surface of the inner frame is provided on an inner surface of a front wall of the inner package.

27. A container according to claim 17 wherein at least a portion of the outer surface of the front wall of the inner package is permanently affixed to a corresponding portion of the inner surface of the front wall of the box.

28. A container according to claim 17 wherein the access opening of the inner package is defined by one or more lines of weakness in the inner package.

29. A container according to claim 28 wherein the adhesive label is permanently affixed to the portion of an outer surface of the inner package bounded by the one or more lines of weakness.

* * * * *